US008567124B2

(12) United States Patent
Alexander

(10) Patent No.: US 8,567,124 B2
(45) Date of Patent: Oct. 29, 2013

(54) AUTOMATED WINDOW SYSTEM WITH AN OVERCENTER DRIVE MECHANISM

(75) Inventor: Edwin John Alexander, Whiteside (AU)

(73) Assignee: Breezway Australia (Holdings) Pty Ltd (AU)

( * ) Notice: Subject to any disclaimer, the term of this patent is extended or adjusted under 35 U.S.C. 154(b) by 784 days.

(21) Appl. No.: 11/720,750

(22) PCT Filed: Dec. 1, 2005

(86) PCT No.: PCT/AU2005/001811

§ 371 (c)(1),
(2), (4) Date: Jun. 28, 2007

(87) PCT Pub. No.: WO2006/058376

PCT Pub. Date: Jun. 8, 2006

(65) Prior Publication Data

US 2007/0261307 A1 Nov. 15, 2007

(30) Foreign Application Priority Data

Dec. 2, 2004 (AU) ..... 2004906883
Apr. 20, 2005 (AU) ..... 2005901980

(51) Int. Cl.
*E06B 7/096* (2006.01)

(52) U.S. Cl.
USPC ..... 49/82.1; 49/138; 49/403

(58) Field of Classification Search
USPC ..... 49/82.1, 74.1, 403, 138
See application file for complete search history.

(56) References Cited

U.S. PATENT DOCUMENTS

| | | | | |
|---|---|---|---|---|
| 2,675,228 | A * | 4/1954 | Baird et al. | 49/21 |
| 2,981,538 | A * | 4/1961 | Bennett | 49/82.1 |
| 3,350,814 | A * | 11/1967 | Dufrene | 49/82.1 |
| 3,809,141 | A * | 5/1974 | Loerop | 160/89 |
| 5,413,161 | A | 5/1995 | Corrazzini | |
| 5,467,556 | A | 11/1995 | Lin | |
| 5,600,920 | A * | 2/1997 | Roy | 49/64 |
| 5,760,558 | A * | 6/1998 | Popat | 318/480 |
| 5,816,306 | A * | 10/1998 | Giacomel | 160/6 |
| 6,038,816 | A | 3/2000 | Park | |
| 7,178,291 | B2 * | 2/2007 | Vasquez | 49/82.1 |
| 7,389,609 | B2 * | 6/2008 | Yorgason | 49/82.1 |

FOREIGN PATENT DOCUMENTS

| | | | |
|---|---|---|---|
| DE | 19543887 | A | 6/1996 |
| DE | 19726021 | A | 12/1998 |
| DE | 10301045 | A | 7/2004 |
| EP | 1531230 | A | 5/2005 |
| FR | 2708029 | A | 1/1995 |
| GB | 2396657 | A | 6/2004 |
| WO | 2004083587 | A | 9/2004 |

OTHER PUBLICATIONS

International Search Report, PCT/AU2005/001811, Mar. 10, 2006.

* cited by examiner

*Primary Examiner* — Katherine Mitchell
*Assistant Examiner* — Catherine A Kelly
(74) *Attorney, Agent, or Firm* — Thomas A. Runk; Fulwider Patton LLP

(57) ABSTRACT

An automated window system including an energy accumulation means, and a window opening/closing mechanism associated with the energy accumulation means wherein the energy accumulation means releases at least a portion of the energy stored therein upon demand to the window opening/closing mechanism to open and/or close the window.

17 Claims, 2 Drawing Sheets

AUTOMATED WINDOW SYSTEM WITH AN OVERCENTER DRIVE MECHANISM

RELATED APPLICATIONS

This is a U.S. national phase application of PCT/AU2005/001811 (WO 2006/058376 A1), filed Dec. 1, 2005, which claims priority to Australian Application No. 2005901980, filed Apr. 20, 2005 and Australian Application No. 2004906883, filed Dec. 2, 2004.

FIELD OF THE INVENTION

The present invention relates to window systems and in particular to an automated window system allowing the opening and closing of a window.

BACKGROUND ART

There are a number of mechanisms by which window in buildings are opened and/or closed.

These mechanisms include:

Direct operation of a handle to unlock the window and then manual operation of the handle to open/close the window sash or by exerting manual force to the window sash;

A gearbox with a manually operated handle remotely connected to the window sash via links, rods or cables. Operation of the gearbox handle controls the opening/closing of the window sash;

An electric motor/gearbox is directly or remotely attached to the sash and the opening/closing of the window sash is controlled by activating or deactivating the motor either directly or indirectly.

These systems require energy only when the window is being opened or closed. Therefore, they involve a relatively large amount of energy, but generally only for the short period of time in which the movement of the window takes place. These systems and devices are therefore "sized" in accordance with the high energy requirements in mind.

The inventors of the present invention have found that utilisation of a low power multiple cycle means to "charge" an accumulator, the size of the system used to open/close the window can be reduced while maintaining the availability of the large amounts of energy needed to open/close the window.

Further, when moving the louvres in a louvre window from a point where the louvres are fully open to the point where the louvres are fully closed, the maximum load that needs to be overcome by a drive mechanism and therefore the maximum force that needs to be applied is that over the final 10° of the closing cycle (and the first 10° of the opening cycle).

Presently louvres are operated manually via a handle which is connected to the louvre operating mechanism or remotely via rods/links to a remote manual or pneumatic or electric device as a power source.

Some issues associated with the conventional mechanisms used to accomplish the movement are:

The basic mechanics of the remote mechanisms are such that they become less efficient as the louvre approaches the locking/final closed position, that is, the position where the maximum force is required. As a result, the device is deliberately engineered according to the maximum force required to be overcome and the apparatus used is consequently large or oversized (when compared to an apparatus that is only designed to operate the louvres through the rest of the cycle). The size of the apparatus means that it cannot be housed within the window frame, and all rods or other linkages are located outside the window frame.

The rods/links and power source are all outside the frame as well due to their size and must be installed separately after the louvre window has been installed, making the device unsightly.

The energy required to drive the system is (relatively) very high because of the inbuilt inefficiency at the point of highest load.

The cost of the remote control system (whether manual or electric) is high (both in component cost and installation cost) because of the size of the equipment required to overcome the high load point.

The system is aesthetically undesirable due to the exposure of the drive system and rods/links.

It would therefore be a significant advance over the conventional mechanisms if a drive mechanism is provided such that its mechanical advantage is at its greatest at the point where the drive mechanism has to overcome the highest load and that the mechanisms mechanical advantage is at its least when the resistance is least.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to an automated window system, which may at least partially overcome at least one of the abovementioned disadvantages or provide the consumer with a useful or commercial choice.

In one broad form, the invention resides in an automated window system including an energy accumulation means, and a window opening/closing mechanism associated with the energy accumulation means wherein the energy accumulation means releases at least a portion of the energy stored therein upon demand to the window opening/closing mechanism to open and/or close the window.

In a preferred form, the energy accumulation means may preferably include an energy accumulation portion and an energy storage portion. The energy accumulation portion collects or accumulates energy which is then stored in the energy storage portion. It is particularly preferred that the energy accumulation portion "trickle charges" the energy storage portion and the energy accumulation portion may take a relatively long period of low energy accumulation to "charge" the energy storage portion. The energy accumulation portion may collect or accumulate energy from a repetitious or renewable source such as solar power, wind or tidal power or multiple cycle means.

The energy accumulation portion will preferably be separated from the energy storage portion but in suitable communication therewith allowing the transfer of energy from the energy accumulation portion to the energy storage portion. Typically, the energy transfer is a one-way transfer from the energy accumulation portion to the energy storage portion. The energy storage portion may deliver at least a portion of the stored energy upon demand to a window opening/closing mechanism to open and/or close the window. This will generally deplete or decrease the amount of energy stored in the energy storage portion which will then be again "charged" by the energy accumulation portion.

The energy storage portion may be any suitable means such as for example, a battery (preferably high capacity and small in size) or a reservoir or the like. The energy accumulation means will typically operate on an electric potential basis, but other bases may be used such as potential energy or fluid or the like.

In a more particular form, the invention resides in an automated window system including a multiple cycle means, an accumulator associated with the multiple cycle means, a window opening/closing mechanism associated with the accumulator and wherein the multiple cycle means delivers energy to the accumulator during each cycle, said energy stored by the accumulator and the accumulator delivers at least a portion of the stored energy upon demand to the window opening/closing mechanism to open and/or close the window.

According to the invention, the use of a multiple cycle means allows accumulation of energy over an extended period of time for use by a single movement means when required, to open and/or close the window. One advantage realised by this invention is that the "motor" (which is generally a part of the window opening/closing mechanism) can be greatly reduced in size. In addition, generally the power source for the motor need not be as large as one which is required to store energy for multiple high power, single movement applications. Alternative energy power sources can also be utilised for the low power, multiple cycle means which increases the energy efficiency.

The window system of the invention preferably includes a low power, multiple cycle means.

The low power, multiple cycle means preferably includes at least one shape memory alloy (SMA) wire. SMA's are metals, which exhibit two unique properties, pseudo-elasticity, and the shape memory effect. The most effective and widely used alloys include NiTi (Nickel-Titanium), CuZnAl, and CuAlNi.

The two unique properties described above are made possible through a solid state phase change, that is a molecular rearrangement, which occurs in the shape memory alloy. A solid state phase change is similar in that a molecular rearrangement is occurring, but the molecules remain closely packed so that the substance remains a solid. In most shape memory alloys, a temperature change of only about 10° C. is necessary to initiate this phase change. The two phases, which occur in shape memory alloys, are Martensite, and Austenite.

Martensite, is the relatively soft and easily deformed phase of shape memory alloys, which exists at lower temperatures. Upon deformation this phase takes on a second form. Austenite, the stronger phase of shape memory alloys, occurs at higher temperatures. The shape of the Austenite structure is cubic. The un-deformed Martensite phase is the same size and shape as the cubic Austenite phase on a macroscopic scale, so that no change in size or shape is visible in shape memory alloys until the Martensite is deformed.

The SMA wires will typically be associated with a heating and cooling means. According to a particularly preferred embodiment, the SMA wires may be associated with an alternative energy source such as solar collector to heat the wires to activate the extension properties. The wires may cool naturally or cooling means may be provided to cool the wires.

The SMA wire will suitably be associated with a reciprocating means, such as a piston and cylinder arrangement, so that the cyclic lengthening and shortening of the wire provides the motive force to reciprocate the piston or cylinder. The reciprocating means preferably forces a working fluid to a higher pressure, and the increase in pressure is communicated to the accumulator.

There may be one or more means interposed between the SMA wires and the reciprocating means to convert the relatively small extension and shortening of the SMA wire into a larger movement. Levers are a typical example of means which may be used for this purpose. The main purpose of the lever is to convert the relatively small force exerted by the SMA wires into a greater force to facilitate movement of the piston. This is suitably achieved due to the location of the fulcrum for the lever.

The piston and cylinder will suitably be associated with a reservoir for containing working fluid. The reservoir may contain working fluid at ambient conditions upon which the reciprocating means can draw. Preferably the reservoir may be provided with means to ensure that the working fluid within the reservoir is not held at an increased pressure. This means may be as simple as a vent communicable with the atmosphere or a more complex pressure modification means.

The accumulator associated with the multiple cycle means acts to store the energy delivered to it by the cyclic action of the multiple cycle means. In practice, the accumulator may store the working fluid that has been pressurised by the piston and cylinder of the multiple cycle means. Alternative configurations may be the storage of the working fluid at an elevated level and allowing the fluid to drain downward upon demand, thus utilising the potential energy in the fluid to activate the single cycle means.

The single movement window opening/closing mechanism associated with the accumulator may suitably be capable of multiple movements, but only one movement per activation. The single movement means will typically have enough torque, force or energy to drive the movement of the windows. As such, it may be a high power means. The single movement means will either open the window or close the window. The single movement means may be configured to partially open or closed condition.

The mechanism will typically include a second piston and cylinder arrangement. The accumulator will deliver at least a portion of the stored energy upon demand to the single movement window opening/closing mechanism to open and/or close the window. As stated above, the window opening/closing mechanism may be capable of repeated single movements, driving the windows to the open condition if closed and the closed condition if open, or part way between the open and closed conditions if preferred. The single movements may be repeatable at closely spaced intervals and it is therefore preferred that the accumulator delivers only a portion of the stored energy to the single movement window opening/closing mechanism. Suitably, the accumulator may be capable of storing energy for a number of activations without the need for "charging" by the multiple cycle means.

The system may also preferably include an automatic switching mechanism associated with the single movement window opening/closing mechanism such that if the windows are opened, the switching mechanism is automatically switched such that the next movement is a closing movement. If the windows are closed, then switching mechanism is preferably automatically switched such that the next movement is an opening movement. A stepwise opening and closing order may be provided.

According to a second form, the invention resides in an overcenter drive mechanism for a louvre window system including at least one operating bar adapted to open and close the louvres by its movement, the overcenter drive mechanism including a wheel means, at least one link member associated with the wheel means and at least one operating bar of the louvre window system, the link attached such that linear movement of the at least one operating bar decreases for a unit radial movement of the wheel means during a period when increased load is experienced in the louvre opening or closing sequence.

The drive mechanism of this form of the invention is typically used with a louvre window operating system which includes at least one operating bar. There will generally be a pair of operating bars. The operating bars are generally located in the U-shaped louvre gallery which is generally oriented substantially perpendicularly to the louvres themselves.

Louvre operating mechanisms generally rotate the end clips to which the louvres are fitted on one side frame portion by engaging with and rotating pivot pins which extend from the end clips an into the U-shaped louvre gallery. The louvres pivot about a substantially central longitudinal axis of the U-shaped louvre gallery which means that the pivot pin is easily accessible to the mechanism. The pivot pins of the louvre end clips are generally associated with a toothed wheel or cog located inside the louvre gallery.

The operating bars of the louvre window opening system will generally be located to either side of the substantially central longitudinal axis of the U-shaped louvre gallery. The operating bars will generally be provided with a set of correspondingly shaped teeth to engage with the toothed wheel or cog associated with the pivot pins. The operating bars located on either side of the toothed wheel or cog generally move in opposite directions. Movement of the operating bars in a first direction causes the toothed wheel or cog to rotate in a first direction, in turn opening or closing the louvre whereas movement of the operating bars in the other direction causes rotation in the opposite direction.

The wheel means of the present invention is preferably a gear. The gear may be a toothed wheel or cog and may generally be a wormwheel or spur gear. Alternatively, the gear may be a simple cylindrical wheel. The gear is driven by a suitable means and this means may be direct such a using a handle to rotate the gear, in which case no teeth are required, or it may be driven by a worm gear associated with a motor for example.

The wheel means is adapted for rotation within the louver gallery. The axis of rotation of the wheel means will generally be parallel to the axis of rotation of the louvres. The wheel means will typically be mounted along the central axis of the louvre gallery as well. There will usually be more than one wheel means associated with each operating bar.

The wheel means of this form of the invention may preferably have at least one central attachment portion to which the link members can be attached. Typically, the wheel means will have a central portion about which the teeth of the cog are arranged at the circumference of the wheel means and also to enable the mounting of the wheel means for rotation within the louvre gallery.

The wheel means may be a part of a louvre opening/closing mechanism according to the first form of the present invention as described above.

Each link member will typically be an elongate member having a first end and a second end. Typically, the first end will be attached to an outer portion of the central attachment portion of the wheel means and the second end will be attached to the operating bar of the louvre operating system. Both of these attachments are typically pivotal attachments allowing the link member to pivot about the operating bar and vice versa. There may be more than one link member and generally a pair of link members will be provided with each wheel means. The pair of link members will typically be attached to opposed sides of the same face of the wheel means.

The components of the drive mechanism are generally to be manufactured from metal but it is anticipated that other materials such as plastics may be used.

According to this form of the present invention, the drive mechanism may be such that the mechanical advantage of the mechanism is at its greatest at the point where the drive mechanism is required to overcome the highest resistance, and at its least when the resistance is least. This may result in a drive mechanism and also an associated drive means and/or power source being much smaller (more energy efficient) than the current art. Due to the reduction in size of the drive means and/or power source results in the advantage that the drive mechanism and possibly a part or whole of the power source can be contained in the window frame, making the complete window free of external rods/links/actuators and the like. On site installation of a complete window and possibly a remote control actuation system may be dramatically reduced if not eliminated altogether, saving costs and improving the aesthetics of the window.

The attachment and geometry of the worm/wheel and the links is such that at the point of the highest load (at final closure and first opening of the louvres) the rotational movement of the wheel means and the links results in a small linear movement of the louvre operating bars. Through the application of basic principles of physics, the force applied can be greater as the distance through which the operating bars have to be moved is smaller.

Typically, the opening and closing rotation of the wheel means may move the attachment point of the first end of the link member to the wheel means approximately 145°. Typically, the main portion of the sequence may take place over approximately 95° of rotation of the wheel means during which the attachment point of the second end of the link member to the operating bar may move approximately 15 mm in linear displacement. The final portion of the sequence may take place over approximately 50° of rotation of the wheel means during which the attachment point of the second end of the link member to the operating bar may move approximately 4 mm in linear displacement. Obviously, the distances moved will differ depending upon the dimension of the window and operating bar. The ratio of the angle of rotation of the main portion of the sequence to the final portion may be between approximately 50:50 to 80:20.

According to still a further form, the invention may reside in an automated window system including a surround frame, a window assembly and means for opening and closing the window wherein all components of the window system are contained within a boundary defined by the surround frame.

In particular, a window system as defined according to this further form can be completely installed in a single fitting and limiting or dispensing with the need for any "secondary" installation on site. It would also reduce the chances for damage to the system components. The window system may be set up as a "turn-key" window wherein the window system requires only a single installation with little or no ancillary installation required.

Preferably all components of the window and the window opening/closing mechanism are located within the surround frame itself. The surround frame will typically comprise a plurality (usually four) frame members and the window opening/closing mechanism may be contained within any one or more of the frame members. The members will typically be substantially U-shaped in cross-section and the mechanism may be located in the U-shaped section.

BRIEF DESCRIPTION OF THE DRAWINGS

Various embodiments of the invention will be described with reference to the following drawings, in which.

DETAILED DESCRIPTION OF THE INVENTION

According to a preferred embodiment of the present invention, an automated window system is provided.

Figure 1:
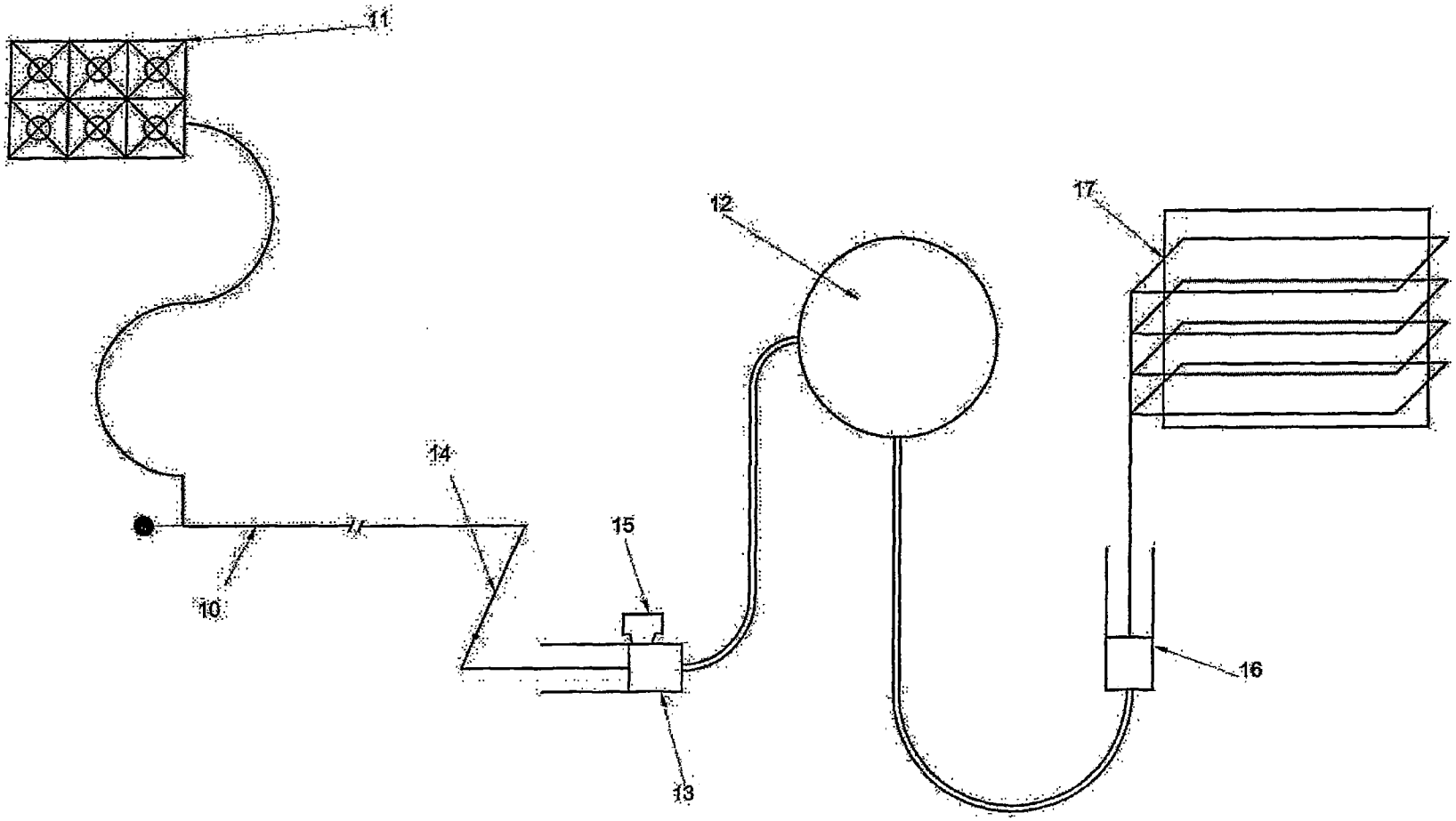
FIG. 1 is a schematic view of an automated window system according to a preferred embodiment of the present invention.

The preferred embodiment of the system of the present invention as illustrated in FIG. 1, includes a low power, multiple cycle piston and cylinder 13. The low power, multiple cycle means includes one or more wires 10 formed of shape memory alloy (SMA).

The SMA wires 10 are associated with one or more photoelectric cells 11 which supply energy (heat) to the SMA wires 10. The SMA wires 10 shorten when heated and lengthen when cooled. This process may occur many times over a given period due to changes in the ambient temperature. The process is thought to be due to a change in the crystal structure of the metal alloy. A particularly preferred SMA material will include a Ni—Ti—Cu alloy.

The preferred embodiment of the system will also include an accumulator 12 associated with the multiple cycle piston and cylinder 13. The accumulator 12 is connected to the SMA wires 10 via a lever 14 mounted such that a reciprocating action of the lever 14 and the piston and cylinder 13 to which the lever is connected is caused by the cyclic lengthening and shortening of the SMA wires 10. The main purpose of the lever 14 is to convert the relatively small force exerted by the SMA wires 10 into a greater force to facilitate movement of the piston due to the location of the fulcrum for the lever. The cylinder 13 is fed working fluid from a reservoir 15 containing such fluid.

The piston 13 is reciprocated by the movement of the lever 14 actuated by the SMA wires 10. As the piston reciprocates, the working fluid is forced into the accumulator 12 from the cylinder during each cycle. There is a one way or non-return valve interposed between the cylinder 13 and the accumulator 12 so that the pressure in the accumulator 12 increases during each cycle.

The pressure in the accumulator 12 rises during each cycle to a preset level, which once attained, causes a diversion of the pressurised fluid back into the fluid reservoir 15. Any further cycling of the piston will not raise the pressure in the reservoir 15 provided the reservoir 15 is vented to maintain the pressure therein.

A high power, single movement piston and cylinder 16 is associated with the accumulator 12 which allows the single movement means 16 to access the increased pressure of the fluid in the accumulator 12 on demand when the window system is activated to open or close. The single movement piston 16 is driven by at least a portion of the pressurised fluid in the accumulator 12 to drive the window between the open and closed conditions.

In this manner, the multiple cycle piston and cylinder 13 delivers energy to the accumulator 12 during each cycle to "charge" the accumulator 12 with increased pressure, at least a portion of the energy stored by the accumulator 12 being available upon demand to the single movement piston and cylinder 16 to open and/or close the window 17. Upon activation of the system to drive the windows 17 to the open condition, the system may be automatically switched such that the next movement of the windows 17 is to the closed condition. A stepwise opening and closing order may be provided, wherein depending on the degree to which the windows 17 are required to open or close, a greater or lesser amount of the stored energy may be released to the single movement piston and cylinder 16.

Figure 2:
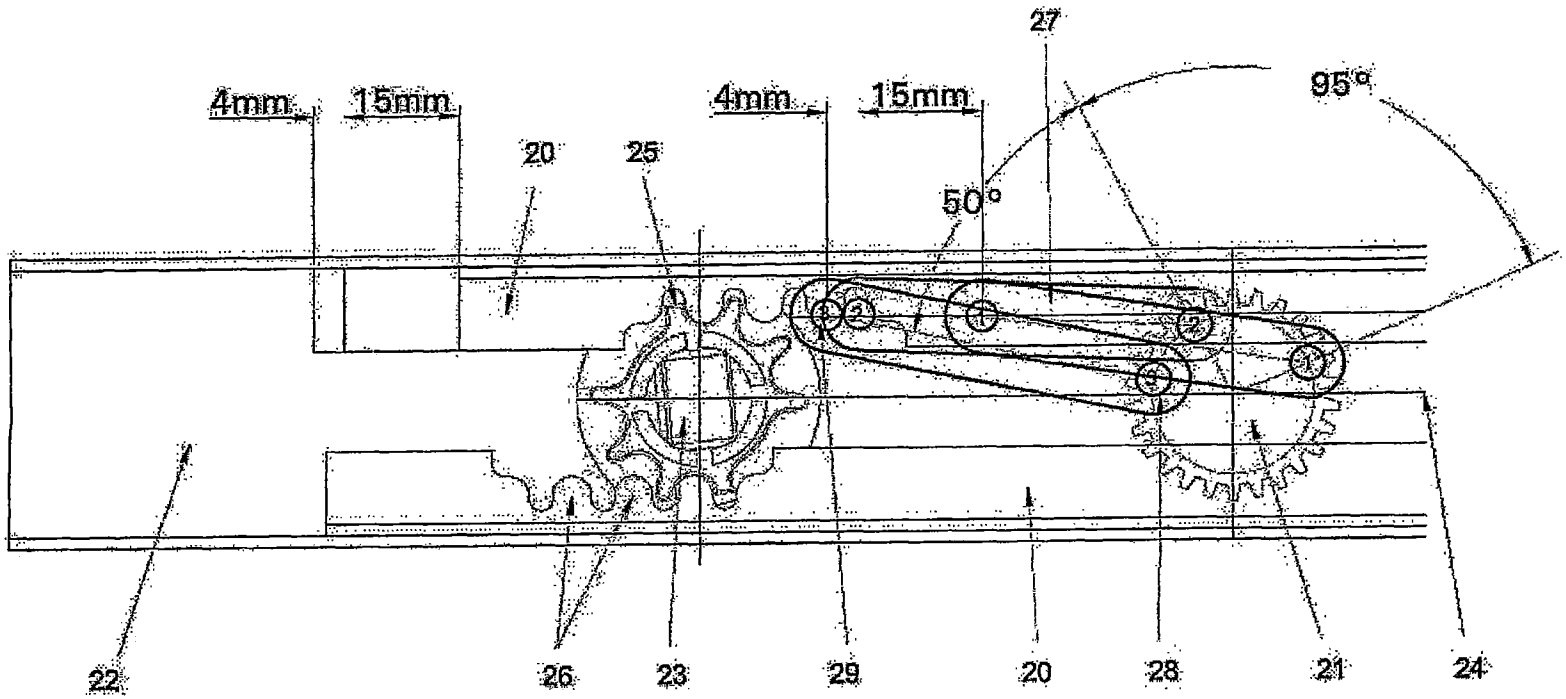
FIG. 2 is a sectional side elevation view of an overcenter drive mechanism according to an embodiment of the present invention.

A second preferred form of the invention is illustrated in FIG. 2, which illustrates an overcenter drive mechanism for a louvre window system. The louvre window system includes a pair of operating bars 20 adapted to open and close the louvres (not shown) by movement. The operating bars 20 are located in the U-shaped louvre gallery 22 which is oriented substantially perpendicularly to the louvres themselves.

Louvre operating mechanisms, such as that illustrated generally rotate louvre end clips to which the louvres are fitted on one side of the louvre gallery 22 by engaging with and rotating, pivot pins 23 which extend from the end clips and into the louvre gallery 22. The louvres pivot about a substantially central longitudinal axis 24 of the louvre gallery 22 which means that the pivot pin 23 is easily accessible to the mechanism. The pivot pins 23 of the louvre end clips are associated with a toothed cog 25 located inside the louvre gallery 22.

The operating bars 20 of the louvre window opening system are located to either side of the substantially central longitudinal axis 24 of the louvre gallery 22. The operating bars 20 have a set of correspondingly shaped teeth 26 to engage with the toothed cog 25 associated with the pivot pins 23. The operating bars 20 located on either side of the toothed cog 25 move in opposite directions. Movement of the operating bars 20 in a first direction causes the toothed cog 25 to rotate in a first direction, in turn opening or closing the louvres, whereas movement of the operating bars 20 in the other direction, causes rotation in the opposite direction.

The overcenter drive mechanism of the preferred embodiment includes a gear wheel 21, and a link member 27 which is connected with the gear wheel 21 and at least one operating bar 20 of the louvre window system. The link member 27 is attached such that linear movement of the operating bar 20 decreases for a unit radial movement of the gear wheel 21 during a period when increased load is experienced in the louvre opening or closing sequence.

The gear wheel 21 as illustrated is a wormwheel or spur gear. The gear wheel 21 is driven by a suitable means generally by a worm gear associated with a motor for example.

The gear wheel 21 is adapted for rotation within the louvre gallery 22 with the axis of rotation of the gear wheel 21 parallel to the axis of rotation of the louvres. The gear wheel 21 is mounted along the central longitudinal axis of the louvre gallery 22 as well.

The gear wheel 21 has a central portion which is about which the teeth of the cog are arranged at the circumference of the gear wheel 21 and also to enable the mounting of the gear wheel 21 for rotation within the louvre gallery 22.

The link member 27 is an elongate member having a first end 28 and a second end 29. The first end 28 is attached to an outer portion of the central attachment portion of the gear wheel 21 and the second end 29 is attached to the operating bar 20 of the louvre operating system. Both of these attachments are pivotal attachments allowing the link member 27 to pivot about the operating bar 20 and vice versa.

The attachment and geometry of the gear wheel 21 and the link member 27 is such that at the point of the highest load (at final closure (between positions 2 and 3) and first opening of the louvres) the rotational movement of the gear wheel 21 and the link 27 results in a small linear movement of the louvre operating bar 20.

FIG. 2 illustrates the link member 27 in three different positions with the first and second end of the link member 27 showing either position 1, 2 or 3. The opening and closing rotation of the gear wheel 21 moves the attachment point of the first end 28 of the link member 27 to the gear wheel 21 approximately 145° as illustrated in FIG. 2. The main portion (position 1 to position 2) of the sequence takes place over approximately 95° of rotation of the gear wheel 21 during which the attachment point of the second end 29 of the link member 27 to the operating bar 20 moves approximately 15 mm in linear displacement. The final portion (position 2 to position 3) of the sequence takes place over approximately 50° of rotation of the gear wheel 21 during which the attachment point of the second end 29 of the link member 27 to the operating bar 20 moves approximately 4 mm in linear displacement. So, the same shaft work is used to translate the operating bar 20 a smaller distance and thus increases the force which may be applied during the final portion of the sequence.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. An automated louvre window system for a window opening, the system including:

a. a plurality of louvre members;

b. a plurality of louvre end clips where each one of the plurality of louvre end clips is associated with a respective one of the plurality of louvre members;

c. a surround frame including a plurality of frame members, including a pair of U-shaped louvre gallery members, each louvre gallery member having a face wall through which the plurality of louvre end clips are mounted and a pair of side walls extending substantially perpendicularly thereto;

d. at least some of the plurality of louvre end clips each having a respective pivot member attached thereto and extending through at least one of the plurality of frame members; and e. a drive mechanism for opening and closing the louvre members to cover and seal the window opening, the drive mechanism including a pair of substantially rigid operating bars adapted to open and close the louvre members by their movement, each of the substantially rigid operating bars having a first portion to abut a slide surface of a respective one of the pair of U-shaped louvre gallery members and a second portion extending substantially perpendicularly thereto with a number of engagement sections with one of the pair of operating bars provided on either side of the respective pivot member of each of the at least some of the plurality of louvre clips and engaged therewith, a substantially planar powered drive wheel, at least one substantially planar link member associated with both the wheel and at least one of the substantially rigid operating bars of the louvre window system, a plane defined by the respective first portions of each of the substantially rigid operating bars, the substantially planar powered drive wheel and the at least one substantially planar link member all being parallel to one another, the at least one link member having a first end attached pivotally but directly with the powered drive wheel and a second end attached pivotally but directly with at least one of the operating bars such that linear movement of the rigid operating bars decreases for a unit radial movement of the drive wheel during a period when increased load is experienced in a louvre opening sequence or closing sequence.

2. An automated window system according to claim 1 including an energy accumulation system, and a window opening and closing mechanism associated with the energy accumulation system wherein the energy accumulation system releases at least a portion of the energy stored therein upon demand to the window opening and closing mechanism to open and close the automated louvre window system.

3. An automated window system according to claim 2 wherein the energy accumulation system includes an energy accumulation portion and an energy storage portion, such that the energy accumulation portion collects or accumulates energy which is then stored in the energy storage portion.

4. An automated window system according to claim 3 wherein the energy accumulation portion collects or accumulates energy from a renewable source such as solar power, wind, or tidal power, or multiple cycle source.

5. An automated window system according to claim 2 including a multiple cycle source, an accumulator associated with the multiple cycle source, a window opening and closing mechanism associated with the accumulator and wherein the multiple cycle source delivers energy to the accumulator during each cycle, said energy being stored by the accumulator and at least a portion of the stored energy being delivered upon demand to the window opening and closing mechanism to open and close the automated louvre window system.

6. An automated window system according to claim 5 wherein the multiple cycle source includes at least one shape memory alloy (SMA) wire.

7. An automated window system according to claim 6 whereint he at least SMA wire is associated with a heating and a cooling mechanism.

8. An automated window system according to claim 6 wherein the at least one SMA wire is associated with a reciprocating drive, so that cyclic lengthening and shortening of the wire provides a motive force to the reciprocating drive which delivers energy to the accumulator during each reciprocation.

9. An automated window system according to claim 5 wherein the window opening and closing mechanism associated with the accumulator is capable of only one movement of the window per activation of energy stored in the accumulator.

10. An automated window system according to claim 5 further including an automatic switching mechanism associated with the window opening and closing mechanism such that if the windows are opened, the switching mechanism is automatically switched such that the next movement is a closing movement and if the windows are closed, then switching mechanism is preferably automatically switched such that the next movement is an opening movement.

11. An automated window system according to claim 1 wherein each of the plurality of louvre members is associated with a respective one of a plurality of toothed wheels located inside the surround frame, and each rigid operating bar is provided with a set of correspondingly shaped teeth to engage with the toothed wheels.

12. An automated window system according to claim 1 wherein the drive wheel is a toothed wheel having at least one central attachment portion about which the teeth of the drive wheel are arranged and to which the first end of the at least one substantially planar link member is attached.

13. An automated window system according to claim 12 wherein each link member is an elongate member and, the first end of each link member is attached to an outer portion of the central attachment portion of the drive wheel.

14. An automated window system according to claim 13 wherein the opening and closing rotation of the drive wheel moves the attachment point of the first end of the link member to the drive wheel approximately 145°.

15. An automated window system according to claim 14 wherein the window opening and closing sequences each include at least two portions, a main portion of the sequence taking place over approximately 95° of rotation of the drive wheel and a final portion of the sequence taking place over approximately 50° of rotation of the drive wheel.

16. An automated window system according to claim 14 wherein the window opening and closing sequences each include at least two portions, a main portion and a final portion and the ratio of the angle of rotation of the main portion of the sequence to the final portion is between approximately 50:50 to 80:20.

17. An automated louvre window system for a window opening, the system including:

a. a plurality of louvre members;

b. a plurality of louvre end clips where each one of the plurality of louvre end clips is associated with a respective one of the plurality of louvre members;

c. a surround frame including a plurality of frame members, including a pair of U-shaped louvre gallery members, each louvre gallery member having a face wall through which the plurality of louvre end clips are mounted and a pair of side walls extending substantially perpendicularly thereto;

d. at least some of the plurality of louvre end clips each having a respective pivot member attached thereto and extending through at least one of the plurality of frame members; and e. a drive mechanism for opening and closing the louvre members to cover and seal the window opening, the drive mechanism including a pair of substantially rigid operating bars adapted to open and close the louvre members by their movement, each of the substantially rigid operating bars having a first portion to abut a slide surface of a respective one of the pair of U-shaped louvre gallery members and a second portion extending substantially perpendicularly thereto with a number of engagement sections with one of the pair of operating bars provided on either side of the respective pivot member of each of the at least some of the plurality of louvre clips and engaged therewith, a substantially planar powered drive wheel, at least one substantially planar link member having a first end attached pivotally but directly with the substantially planar powered drive wheel and a second end attached pivotally but directly with at least one of the substantially rigid operating bars of the louvre window system such that linear movement of the rigid operating bars decreases for a unit radial movement of the drive wheel during a period when increased load is experienced in a louvre opening sequence or closing sequence, a plane defined by each of the respective first portions of the substantially rigid operating bars, the substantially planar powered drive wheel and the at least one substantially planar link member all being parallel to one another;

an energy accumulation system including an energy accumulation portion and an energy storage portion, such that the energy accumulation portion collects or accumulates energy from a renewable source which is then stored in the energy storage portion, the energy storage portion releases at least a portion of the energy stored therein upon demand to the window opening and closing mechanism to open and close the automated louvre window system, wherein the drive mechanism is contained within the surround frame.

* * * * *